US005609986A

United States Patent [19]

Feduzi et al.

[11] Patent Number: 5,609,986

[45] Date of Patent: Mar. 11, 1997

[54] AGEING IMPROVEMENTS OF PHOTOGRAPHIC ELEMENTS COMPRISING DEXTRAN

[75] Inventors: Rino Feduzi, Ranco; Cristina Soncini, Savona; Antonella Celada, Genoa; Salvatore Selvaggio, Albenga; Ivo Zullo, Cairo Montenotte, all of Italy

[73] Assignee: Minnesota Mining and Manufacturing, St. Paul, Minn.

[21] Appl. No.: 638,068

[22] Filed: Apr. 25, 1996

[30] Foreign Application Priority Data

Jun. 2, 1995 [EP] European Pat. Off. ..... 95108519

[51] Int. Cl.[6] ..... G03C 1/04; G03C 1/295

[52] U.S. Cl. ..... 430/264; 430/628; 430/640; 430/599; 430/602

[58] Field of Search ..... 430/264, 628, 430/640, 600, 599, 602

[56] References Cited

U.S. PATENT DOCUMENTS

| | | | |
|---|---|---|---|
| 4,693,956 | 9/1987 | Marchesano | 430/264 |
| 4,746,594 | 5/1988 | Kasama et al. | 430/264 |
| 4,777,118 | 10/1988 | Kitchen et al. | 430/264 |
| 5,019,494 | 5/1991 | Toya et al. | 430/640 |
| 5,041,355 | 8/1991 | Machonkin et al. | 430/264 |
| 5,126,227 | 6/1992 | Machonkin et al. | 430/264 |
| 5,476,747 | 12/1995 | Yoshida et al. | 430/264 |

*Primary Examiner*—Richard L. Schilling
*Attorney, Agent, or Firm*—Gary L. Griswold; Walter N. Kirn; Gregory A. Evearitt

[57] ABSTRACT

The present invention relates to a process for improving the ageing properties of a silver halide photographic element, free of photolytically generated latent images, comprising a support bearing at least one light-sensitive silver halide emulsion layer and at least one light-insensitive layer, the silver halide light-sensitive emulsion layer including negative acting surface latent image-type silver halide grain in association with a contrast promoting agent and a hydrazine compound, by adding a total amount of at least 0.40 grams per square meter of dextran to at least said light-sensitive silver halide emulsion layer and/or to at least said light-insensitive layer.

10 Claims, No Drawings

AGEING IMPROVEMENTS OF PHOTOGRAPHIC ELEMENTS COMPRISING DEXTRAN

FIELD OF THE INVENTION

This invention relates to photographic elements, in particular to black-and-white photographic elements useful in obtaining ultra high contrasts for graphic arts films.

BACKGROUND OF THE INVENTION

In forming high contrast images necessary for Graphic Arts processes by development of silver halide photographic elements, special developers known in the art as "lith" developers are used. The high contrast is achieved by means of the infectious development as described in *Journal of the Franklin Institute*, vol. 239, 221–230 (1945). These developers exhibit an induction period prior to the development of exposed silver halides, after which the infectious development occurs, which gives rise to the high contrast.

The typical "lith" developer contains only a single developing agent of the dihydroxybenzene type, such as hydroquinone. To enhance the infectious development, "lith" developers contain a low content of alkali sulfite. This low sulfite content renders the developer more prone to aerial oxidation, especially when it is used in combination with processing machines and, more particularly, with Rapid Access type processing machines, where developer degradation is accelerated.

The delay in the start of development caused by the long induction period of hydroquinone developers lengthens the processing time and delays access to the finished material. While the induction period has been eliminated and processing time reduced by using the so called "Rapid Access" developers, which contain both hydroquinone and a superadditive developing agent such as phenidone or metol, these Rapid Access developers are not useful for lithographic purposes because they cannot produce the necessary high contrast. This is because Rapid Access developers have a high sulfite content which prevents infectious development and causes a lower contrast than "lith" developers.

Several alternatives to using a hydroquinone developing agent with a low sulfite content of the "lith" processing system to achieve high contrast development are known in the art. They are the so-called "high contrast" processing systems which use a hydrazine compound, either in the photographic element or in the developing solution, to promote high contrast. The use of hydrazine compounds allows the use of auxiliary developing agents in combination with the dihydroxybenzene developing agent to increase the developing capacity. It also allows the use of relatively high sulfite concentration to protect the developing agents against oxidation, and thereby increasing the developer stability. The high pH level, about 10.5 to 12.8, necessary to obtain the high contrast from the use of hydrazine compounds makes the life of the developing solution relatively short.

Processes which make use of hydrazine are disclosed in U.S. Pat. Nos. 2,419,975; 4,168,977 and 4,224,401. Modifications and improvements to the hydrazine process are disclosed in U.S. Pat. Nos. 2,410,690; 2,419,974; 4,166,742; 4,221,857; 4,237,214; 4,241,164; 4,243,739; 4,272,606; 4,272,614; 4,311,871; 4,323,643; 4,332,878 and 4,337,634 and in Research Disclosure No. 235, Nov. 1983, Item 23510 "Development nucleation by hydrazine and hydrazine derivatives". Despite the improvements which have been made in the hydrazine process, a remaining inconvenience is the relatively low stability of the developer to aerial oxidation, which is a consequence of the high pH required to achieve the desired high contrast.

Contrast promoting agents have been described in U.S. Pat. Nos. 4,172,728 and 4,269,929, in EP 155,690 and in the above cited Research Disclosure which, incorporated in the developing solution, allow the photographic element, including the hydrazine compound, to reach the desired high contrast at a lower pH.

High contrast developing compositions which contain amino compounds and are intended for carrying out development in the presence of a hydrazine compound are also disclosed in U.S. Pat. Nos. 4,668,605 and 4,740,452. In fact, U.S. Pat. No. 4,668,605 describes developing compositions containing a dihydroxybenzene, a p-aminophenol, a sulfite, a contrast promoting amount of an alkanolamine comprising a hydroxyalkyl group of 2 to 10 carbon atoms and a mercapto compound. The developing compositions of U.S. Pat. No. 4,740,452 contain a contrast promoting amount of certain trialkyl amines, monoalkyl-dialkanolamines or dialkylmonoalkanol amines. However, the need to use the contrast promoting agent in a large amount and the volatility and odor-generating characteristics-of amino compounds that are effective in enhancing contrast represent disadvantageous characteristics of the developer solution therein described.

U.S. Pat. Nos. 4,937,160 and 5,190,847 disclose photographic silver halide elements containing an aryl hydrazide having a cationic group for the production of images with ultrahigh contrast. The photographic elements can be developed at relatively low pH, in the range 10.0–11.5 values, by a developing solution including contrast promoting agents such as alkanolamines or secondary aliphatic or aromatic alcohols. Low fog and low tendency to form black spots in unexposed or slightly exposed areas are obtained.

U.S. Pat. No. 4,777,118 discloses a process for forming a high contrast negative photographic image by developing a silver halide photographic element, in the presence of a hydrazine compound as nucleating agent, with an alkali aqueous developing solution which contains a combination of developing agent comprising hydroquinone or substituted hydroquinone and a superadditive developing agent and an antioxidant, wherein the developing solution has a pH lower than about 12 and wherein the silver halide photographic element comprises, an emulsion layer including surface latent image negative type silver halide grains in reactive association with a contrast promoting agent, preferably a diarylcarbinol compound, in a quantity useful to increase contrast. However, in practice, said photographic elements produce photographic images having high contrasts and adequate image quality only when processed by a developing solution at a pH over 11.5. In addition, at lower pH values, in the range from 9.0 to 11.0, the developer solutions are not stable enough. In particular they are very sensitive to atmospheric oxygen, despite their high sulfite content.

U.S. Pat. No. 4,914,003 describes a photographic material containing a generic hydrazine compound as nucleating agent and a specified amine compound as contrast promoting agent to obtain a superhigh contrast negative image when processed by a developing solution having a pH value of 10.5 to 12.0.

Recently, it has been found that well defined photographic elements can be developed in developing solutions having pH below 11.0. For example, U.S. Pat. No. 4,975,354 discloses photographic elements, particularly useful in the field of graphic arts, which are capable of high contrast development, when processed in the presence of a hydrazine compound that functions as a nucleating agent. The elements include certain amino compounds which function as incorporated booster. The characteristics of the compounds contained in the photographic element allow the photographic element to be processed in a developer solution having a pH value in the range of 9 to 10.8.

The photographic materials useful to obtain high-contrast images have the disadvantage of loosing the good sensitometric properties during ageing.

The use of dextran is known in black-and-white X-ray film, see for example Japanese Patent Application 04-125,626, wherein the use of hydrophilic polymers, such as dextran and polyacrylic acid, are introduced in photographic layers to control the water content. This practice also provides a high sharpness material without abrasion defects and with good drying characteristics.

Japanese Patent Application 04-019,648 discloses the replacement of gelatin with dextran to obtain high sensitivity and good tone suitable for reproduction of medical X-ray materials.

U.S. Pat. No. 4,710,456 describes the use of dextran for improving the covering power of developed silver without a deterioration in a) the adhesion between a subbing layer and a silver halide photographic emulsion layer and b) roller marking properties.

U.S. Pat. No. 4,916,049 discloses a photosensitive material which contains a hydrophilic colloid layer containing high molecular weight dextran (more than 100,000) to improve adhesion of sensitive emulsion layer.

U.S. Pat. No. 4,920,032 discloses a photosensitive material which contains dextran and a cationic compound containing a quaternary nitrogen to give the material high sensitivity and high scratch resistance when wet.

U.S. Pat. No. 4,186,010 describes a black-and-white photographic element comprising a compound for increasing covering power selected from the group consisting of dextran and an alkali salt of a low molecular weight maleic anhydride polymer, and a polymeric compound containing recurring units with ketoiminoguanidium groups.

U.S. Pat. No. 5,019,494 describes a silver halide photographic material which comprises a support having thereon a colloid layer which comprises a binder comprising a dextran having a molecular weight of at least 100,000 and an ionic polymer to give improved sensitivity and to be suitable for coating over prolonged periods of time.

U.S. Pat. Nos. 4,975,354; 5,041,355 and 5,126,227 describe a photographic material containing specified classes of hydrazine compounds and of contrast promoting agents useful in graphic arts to obtain high contrasts. The preferred binder disclosed in said patents is gelatin, but other binders such as, for example, dextran, gum arabic, zein, casein, pectin and the like can be used.

It would be desirable to obtain a photographic material providing a very high contrast and good dot quality upon development, in the presence of a hydrazine compound and of a contrast promoting agent, with a conventional Rapid Access type developer solution at a pH value lower than 11.0, said material also having very good ageing properties.

SUMMARY OF THE INVENTION

The present invention relates to a silver halide photographic element and to a process for improving the ageing properties of said silver halide photographic element when free of photolytically generated latent images. The element comprises a support bearing at least one gelatin light-sensitive silver halide emulsion layer and at least one gelatin light-insensitive layer, the silver halide light-sensitive emulsion layer including negative acting surface latent image-type silver halide grain in association with a contrast promoting agent and a hydrazine compound, wherein a total amount of at least 0.40 grams per square meter of dextran is contained in the gelatin light-sensitive silver halide emulsion layer and/or in the gelatin light-insensitive layer.

The addition of dextran to a silver halide photographic element containing a contrast promoting agent and a hydrazine compound allows to obtain a photographic material providing a very high contrast and good dot quality upon development, said material also having very good ageing properties.

DETAILED DESCRIPTION OF THE INVENTION

In the present invention, dextran may be incorporated into any of the gelatin light-sensitive emulsion layers or in a light-insensitive layer adjacent to the light-sensitive layer, for example in protective layers, in subbing layers, two or more layers, and the like.

The dextran which can be added to the photographic emulsion layer is obtained, for example, by reacting dextran sucrase separated from a culture medium of dextran-producing microorganism (e.g., leuconostoc mesenteroides) with sucrose to obtain native dextran, and partially decomposing and polymerizing the native dextran using an acid, alkali, or enzymes to lower the molecular weight. The average molecular weight of the dextran used in the present invention is generally from 10,000 to 300,000, preferably from 15,000 to 200,000 and more preferably from 20,000 to 180,000.

The timing of the addition of the dextran is not crucial. Preferably the dextran is added in the form of a 5 to 30% aqueous solution.

For the purpose of the present invention the dextran is used in an amount of from about 40 to about 140, preferably from about 50 to about 100 grams per square meter.

The gelatin to dextran ratio is from about 2:1 to about 20:1, preferably from about 3:1 to about 10:1, more preferably from about 4:1 to about 8:1.

Contrast promoting agents useful for high contrast images include hydroxymethylidine group containing compounds, as described in U.S. Pat. No. 4,693,956. Examples of contrast promoting agents are methyl alcohol, 1,3-butanediol, 1,4-cyclohexanediol, phenylmethylcarbinol and the like.

Preferred contrast promoting agents to be incorporated in the photographic element include diarylcarbinol compounds as described in U.S. Pat. No. 4,777,118, such as, for example, benzhydrol, 4,4'-dimetoxydiphenylmethanol, 4,4'-dimethyldiphenylmethanol, 2,2'-di-bromodiphenylmethanol, and the like, and poly(oxyethylene) substituted benzylic alcohols contrast promoting agents having the following general formula (I) or (II):

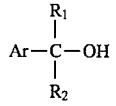

(I)

-continued

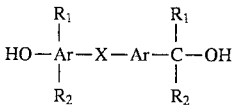

(II)

wherein

Ar is an aromatic group;

$R_1$ and $R_2$, the same or different, being hydrogen, an alkyl group or an aryl group;

X is a divalent linking group containing at least three repeating ethyleneoxy units.

Ar is an aromatic group (e.g., phenyl, naphthyl) containing at least 3 repeating ethyleneoxy units, preferably at least 6, more preferably at least 10 repeating ethyleneoxy units.

$R_1$ and $R_2$, the same or different, represent hydrogen, an alkyl group preferably containing 1 to 8 carbon atoms (e.g., methyl, ethyl, propyl, allyl, butyl, amyl, hexyl, octyl), and more preferably containing 1 to 4 carbon atoms; and an aryl group, preferably containing 6 to 10 carbon atoms (e.g., phenyl, naphthyl).

When the term "group" or "nucleus" is used in the present invention, the described chemical material includes the basic group or nucleus and that group or nucleus with conventional substituents. When the term "moiety" is used to describe a chemical compound or substituent, only an unsubstituted chemical material is intended to be included. For example, "alkyl group" includes not only such alkyl moieties as methyl, ethyl, octyl, stearyl, etc. but also such moieties bearing substituent groups such as halogen, cyano, hydroxyl, nitro, amine, carboxylate, etc. On the other hand, "alkyl moiety" or "alkyl" includes only methyl, ethyl, octyl, stearyl, cyclohexyl, etc.

Other contrast promoting agents useful for high contrast images are for example the alkanolamine compounds comprising a hydroxyalkyl group of 2 to 10 carbon atoms and a mercapto compound, as described in U.S. Pat. No. 4,668,605 or certain trialkyl amines, monoalkyl-dialkanolamines or dialkylmonoalkanol amines, as described in U.S. Pat. No. 4,740,452. Useful contrast promoting agents also include certain amino compounds which function as incorporated booster described in U.S. Pat. No. 4,975,354. These amino compounds contain within their structure a group comprised of at least three repeating ethylenoxy units.

The amount of said contrast promoting agents is from about $10^{-4}$ to $10^{-1}$ moles per mole of silver, preferably from about $10^{-3}$ to $5\times10^{-2}$ moles per mole of silver.

Examples of contrast promoting agents useful for the purpose of the present invention are listed hereinbelow, but the invention is not limited to them:

CP.1) methyl alcohol

CP.2) 1,3-butanediol

CP.3) 1,4-cyclohexanediol

CP.4) phenylmethylcarbinol

CP.5) benzhydrol

CP.6) 4,4'-dimetoxydiphenylmethanol

CP.7) 4,4'-dimethyldiphenylmethanol

CP.8) 2,2'-di-bromodiphenylmethanol

CP.9) n-butyldiethanolamine

CP.10) n-propyldiethanolamine

CP.11) 2-di-isopropylaminoethanol

CP.12) N,N-di-n-butylethanolamine

CP.13) 3-di-propylamino- 1,2-propanediol

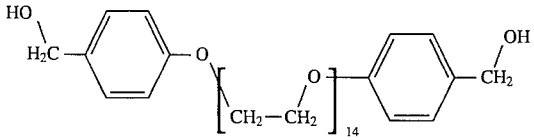

CP. 14)

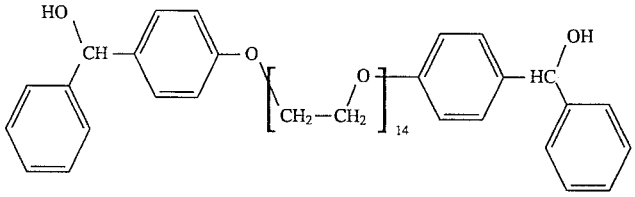

CP. 15)

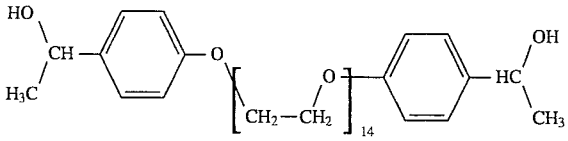

CP. 16)

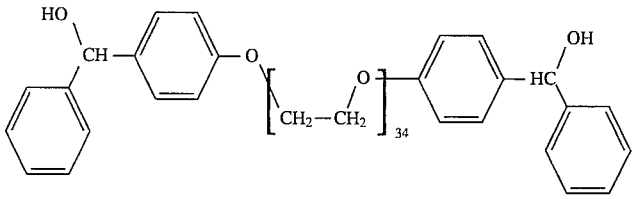

CP. 17)

-continued

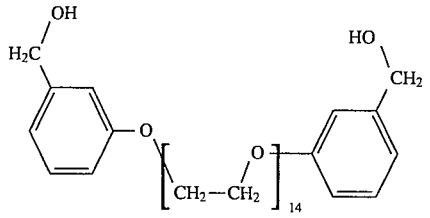

CP. 18)

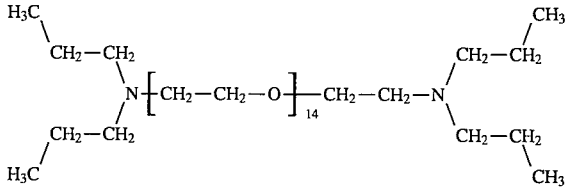

CP. 19)

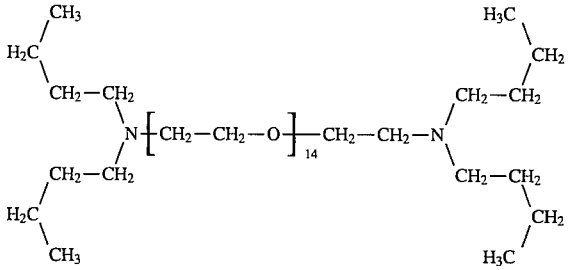

CP. 20)

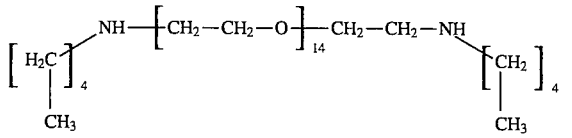

CP. 21)

Hydrazine compounds to be used in the present invention are those represented by the following formula (III):

$$R_3—NH—NH—G—R_4 \quad \text{(III)}$$

wherein $R_3$ represents an aliphatic group or an aromatic group, $R_4$ represents a hydrogen atom, an alkyl group, an aryl group, an alkoxy group, an aryloxy group, and G represents a carbonyl group, a sulfonyl group, a sulfoxy group, a phosphoryl group, or an amino group.

In formula (III), the aliphatic group represented by $R_3$ preferably contains 1 to 30 carbon atoms and is particularly preferred as a straight, branched or cyclic alkyl group containing 1 to 20 carbon atoms. The branched alkyl group may be cyclized to form a saturated hetero ring containing one or more hetero atoms. In formula (III), the aryl group represented by $R_3$ is a monocyclic or bicyclic aryl group or an unsaturated heterocyclic group. The unsaturated heterocyclic group may be fused with a monocyclic or bicyclic aryl group to form a heteroaryl group, such as, for example, a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring, with those which contain a benzene ring being preferable.

In formula (III), $R_4$ is an alkyl group, preferably containing 1 to 8 carbon atoms (e.g., methyl, ethyl, propyl, allyl, butyl), an aryl group, preferably containing 6 to 10 carbon atoms (e.g., phenyl, naphthyl), an alkoxy group, preferably containing 1 to 8 carbon atoms (e.g., methoxy, ethoxy, propyloxy), and an aryloxy group.

Hydrazine compounds useful in the present invention are those disclosed, for example, in GB 598,108 and in U.S. Pat. Nos. 2,410,690; 2,419,974; 4,166,742; 4,168,977; 4,221,857; 4,224,401; 4,237,214; 4,241,164; 4,243,739; 4,272,606; 4,272,614; 4,311,871; 4,323,643; 4,332,878; 4,337,634; 4,686,167; 4,746,593; 4,798,780; 4,914,003; 4,937,160; 4,975,354; 4,988,604; 4,994,365; 5,013,844; 5,041,355; 5,126,227; 5,130;480; 5,190,847; 5,232,818; 5,252,426; 5,279,919; 5,284,732; 5,316,889 and in Research Disclosure No. 235, November 1983, item 23510 "Development nucleation by hydrazine and hydrazine derivatives".

Specific examples of hydrazine compounds useful in the present invention are those listed in the following.

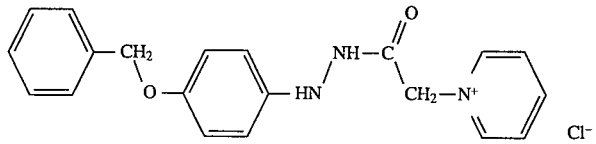

H1

-continued
H2
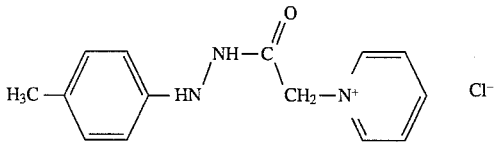
H3
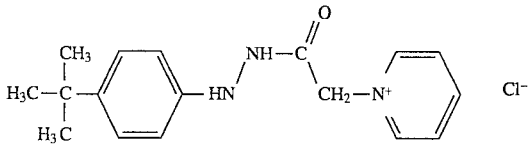
H4
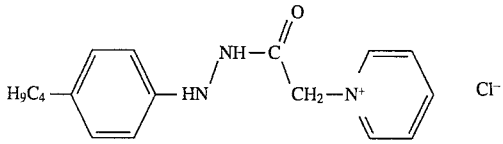
H5
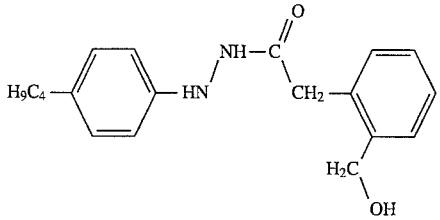
H6
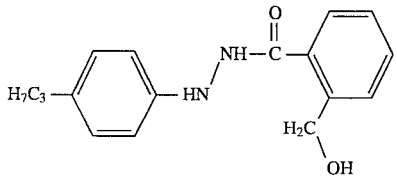
H7
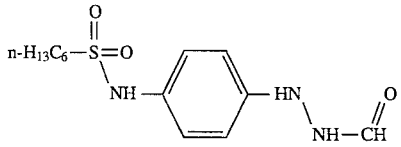
H8
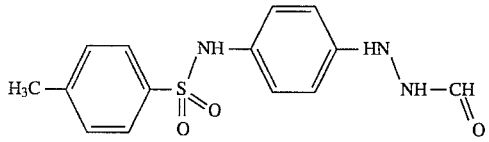
H9
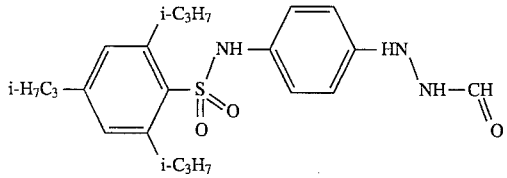
H10
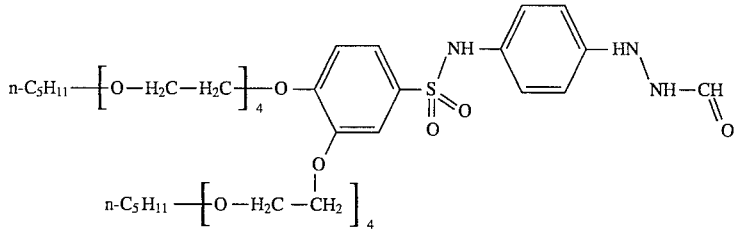

-continued

H11

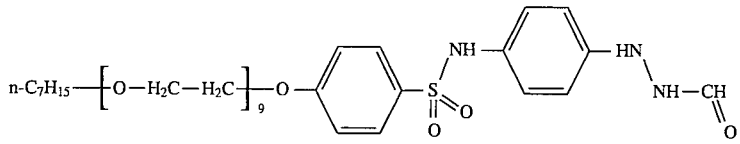

H12

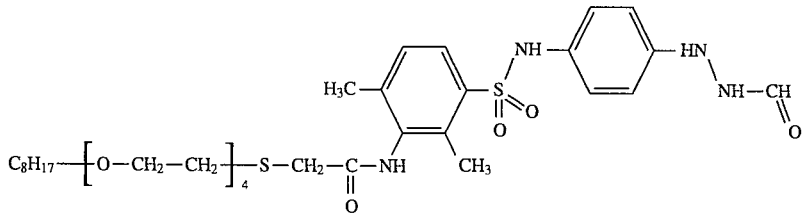

H13

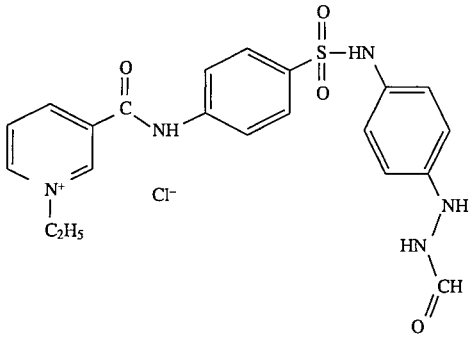

H14

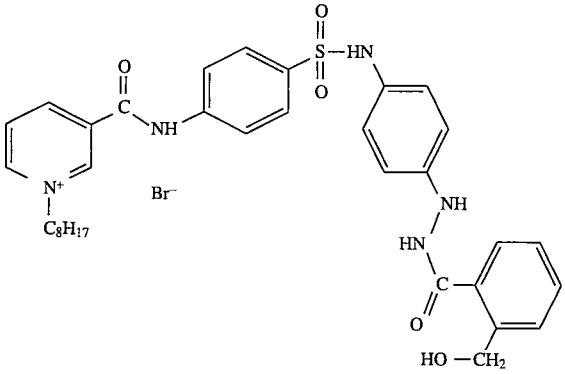

H15

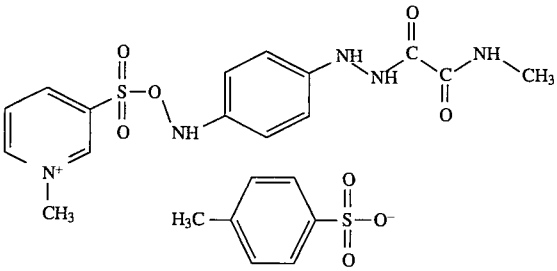

The contrast promoting agents and the hydrazine compounds are incorporated into the photographic element in association with negative-acting surface latent image-type silver halide grains, for example in a silver halide emulsion layer or in a hydrophilic colloidal layer, preferably a hydrophilic colloidal layer adjacent to the emulsion layer in which the effects of the hydrazine compound and of the contrast promoting agent are desired. It can, of course, be present in the photographic element distributed between the emulsion and the hydrophilic colloidal layers, such as subbing layers, interlayers and protective layers.

The hydrazine compound is incorporated into the photographic element using various methods well-known in the photographic art. If containing a ballasting group, the most common method is that of dissolving the hydrazine derivatives in a high boiling crystalloidal solvent and dispersing the mixture in the emulsion, as described, for example, in U.S. Pat. No. 2,322,027.

The amount of said hydrazine compounds is from about $10^{-4}$ to $5\times10^{-2}$ moles per mole of silver, preferably from about $8\times10^{-4}$ to $5\times10^{-3}$ moles per mole of silver.

The silver halide emulsions for use in the present invention may be silver chloride, silver chloro-bromide, silver iodo-bromide, silver iodo-chloride, silver iodo-chloro-bromide or any mixture thereof. Generally, the iodide content of the silver halide emulsions is less than 10% silver iodide moles, said content being based on the total silver halide. The chloride content is generally of at least about 50% of the total silver halide. The silver halide emulsions are usually monodispersed or narrow grain size distribution emulsions, as described for example in U.S. Pat. No. 4,166,742; 4,224,401;4,237,214; 4,241,164; 4,272,614 and 4,311,871.

The silver halide emulsions may comprise a mixtures of emulsions having different grain combinations, for example a combination of an emulsion having a mean grain size below 0.4 μm with an emulsion having a mean grain size above 0.7 μm, as described in Japanese Patent Application S.N. 57–58137 or a combination of two emulsions, both having a grain size below 0.4 μm, such as for example a first silver halide emulsion having a mean grain size from 0.1 to 0.4 μm and a second silver halide emulsion with particles having a mean grain volume lower than one half the particles of the first emulsion.

The silver halide grains of the emulsions of the present invention are capable of forming a surface latent image, as opposed to those emulsions forming an internal latent image. Surface latent image-forming silver halide grains are most employed in negative type silver halide emulsions, while internal latent image-forming silver halide grains, though capable of forming a negative image when developed in an internal developer, are usually employed with surface developers to form direct-positive images. The distinction between surface latent image and internal latent image-forming silver halide grains is well-known in the art. Generally, some additional ingredients or steps are required in the preparation of silver halide grains capable of preferentially forming an internal latent image instead of a surface latent image.

In the silver halide emulsions of the present invention, the precipitation or the growth of the silver halide grains may be carried out in the presence of metal salts or complex salts thereof, such as rhodium and iridium salts or complex salts thereof. According to the present invention, it has been found, anyhow, that the presence of rhodium or iridium is not necessary for obtaining the high contrasts. Silver halide grains free of rhodium or iridium, as well as those formed or ripened in the presence of rhodium or iridium may be used to the purposes of the present invention.

The silver halide emulsions of the present invention may not be chemically sensitized, but are preferably chemically sensitized. As chemical sensitization methods for silver halide emulsions, the known sulfur sensitization employing sulfur compounds, the reduction sensitization employing mild reducing agents and the noble metal sensitization can be used, either alone or in combination.

The silver halide emulsions can be spectrally sensitized with dyes from a variety of classes, including the polymethine dye class, such as cyanines, merocyanines, complex cyanines and merocyanines (i.e., tri-, tetra- and poly-nuclear cyanines and merocyanines), oxonols, hemioxonols, styryls, merostyryls and streptocyanines. The silver halide emulsions can be spectrally sensitized at different wavelengths to be exposed to all the laser exposures, i.e. at 488, 633 and 670 nm.

The binder or protective colloid for the silver halide layer and the layers of the photographic element is preferably gelatin, but other hydrophilic colloids or synthetic water insoluble polymers in the form of latexes can be used to partially or completely replace gelatin.

In addition, the photographic elements of the present invention may also contain any photographic additives known in the art, such as for example stabilizers, antifoggants, hardeners, plasticizers, development accelerators, gelatin extenders, matting agents.

The developing agents employed in the aqueous alkaline developing solution for use in the practice of this invention are well-known and widely used in photographic processings. The developing agents can be selected from the group consisting of polyhydroxybenzene, aminophenol, p-phenylenediamine, ascorbic acid, pyrazolidone, pyrazolone, pyrimidine, dithionite, hydroxylamine or other conventional developing agents. Useful dihydroxybenzene developing agents include hydroquinone, chlorohydroquinone, bromohydroquinone, isopropylhydro-quinone, tolylhydroquinone, methylhydroquinone, 2,3-dichlorohydroquinone, 2,5-di-methylhydroquinone, 2,3-dibromohydroquinone, 1,4-dihydroxy-2-acetophenone-2,5-dimethylhydroquinone, 2,5-diethylhydroquinone, 2,5-di-p-phenethylhydroquinone, 2,5-di-benzoylhydroquinone, 2,5-diacetaminohydroquinone.

The preferred auxiliary developing agents are those described in U.S. Pat. No. 5,236,816; particularly useful are the auxiliary developing agents such as aminophenol and substituted aminophenol (e.g., N-methyl-p-aminophenol, also known as Metol and 2,4-diaminophenol) and the 3-pyrazolidone developing agents (e.g. 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazoliodone. Other useful 3-pyrazolidone developing agents include: 1-phenyl-5-methyl-3-pyrazolidone, 1-p-aminophenyl-4-methyl-4-propyl-3-pyrazolidone, 1-p-chlorophenyl-4-methyl-4-ethyl-3-pyrazolidone, 1-p-acetamido-phenyl-4,4-di-ethyl-3-pyrazolidone, 1-p-β-hydroxyethylphenyl-4,4-dimethyl-3-pyrazolidone, 1-p-hydroxyphenyl-4,4-dimethyl-3-pyrazolidone, 1-p-methoxyphenyl-4,4-diethyl-3-pyrazolidone, 1-p-tolyl-4,4-dimethyl-3-pyrazolidone).

The aqueous alkaline photographic developing solution for use in the practice of this invention contains a sulfite preservative at a level sufficient to protect the developing agents against the aerial oxidation and thereby assure good stability characteristics. Useful sulfite preservatives include sulfites, bisulfites, metabisulfites and carbonyl bisulfite adducts. Typical examples of sulfite preservatives include sodium sulfite, potassium sulfite, lithium sulfite, ammonium sulfite, sodium bisulfite, potassium metabisulfite, sodium formaldehyde bisulfite salt. Also ascorbic acid is a known preservative agent against aerial oxidation of the developer for use in the bath.

The aqueous alkaline developing solutions for use in the practice of this invention can vary widely with respect to the concentration of the various ingredients included therein. Typically, the dihydroxybenzene developing agent is used in an amount of from 0.040 to 0.70 moles per liter, more preferably in an amount of from 0.08 to about 0.40 moles per liter; the 3-pyrazolidone developing agent is used in an amount of from 0.001 to 0.05 moles per liter, more preferably in an amount of from 0.005 to 0.01 moles per liter; the sulfite preservative is used in an amount of from 0.03 to 1.0 moles per liter, more preferably in an amount of from 0.10 to 0.70 moles per liter.

In carrying out the method of this invention, it is preferred to use an organic antifogging agent to minimize fog formation in the processed element. The organic antifogging agent can be incorporated in the photographic element or can be added to the developing solution or can be both incorporated in the photographic element and added to the developing solution. According to the present invention, it has been found that more preferred organic antifogging agents for specific use in the developing solutions are benzotriazole and/or a benzimidazole antifogging agents, which proved to have beneficial effects on increasing contrast. Useful compounds are both substituted and unsubstituted benzotriazole and benzimidazole compounds, with the proviso that electron withdrawing substituents at least as strong as nitro groups are excluded. As a matter of fact, nitro substituted benzotriazole and benzimidazole compounds, although good to prevent fog, do not provide beneficial effects with reference to contrast increase. Benzimidazoles and benzotriazoles, as a class, are believed to be useful in the practice of this invention. Anyhow, as indicated, difficulties in obtaining significantly improved performance with benzotriazoles and benzimidazoles having strong electron withdrawing groups have been encountered. Benzotriazoles and benzimidazoles are therefore preferred not to have any substituents on the aromatic rings which are electron attracting groups as strong as or stronger than a nitro group. Other substituents known in the art such as lower alkyl groups (having 1 to 5 carbon atoms) and halogen substituents (chlorine) proved to be substituents good to the purposes of the invention. Said benzotriazole and benzimidazole antifogging and contrast promoting agents are normally used in amounts effective to prevent fog, although quantity can be optimized to get the best results from the contrast point of view. Useful quantities, when they are included in the emulsion, may vary from 1 to 100 milligrams per 100 grams of emulsion and, when included in the developing bath, as preferred, may vary from 0.01 to 5 grams per liter.

In addition to the essential components specified hereinabove, the developing solutions can optionally contain any of a wide variety of addenda, as known, useful in photographic developing solutions. For example, they can contain solvents, buffers, sequestering agents, development accelerators, agents to reduce swelling of the emulsion layers, and the like.

The invention is further illustrated by the following examples.

EXAMPLE

A cubic $AgBr_{0.30}Cl0.70$ emulsion of narrow grain size distribution and mean grain size of 0.30 um was prepared by the conventional double jet procedure. The emulsion was then coagulated and washed in the conventional manner and reconstituted to give a final gelatin to silver ratio of 100 g gelatin/silver mole. The emulsion was then doped with ruthenium and iridium and was sulfur and gold chemically sensitized. A coating composition was prepared by mixing this emulsion with:

a wetting agent;

a hardener (0.8 g/mole Ag) of formula:

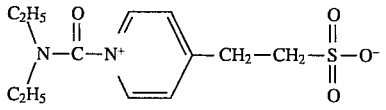

sensitizing dye (0.62 g/mole Ag), sensitive to 488 nm, of formula:

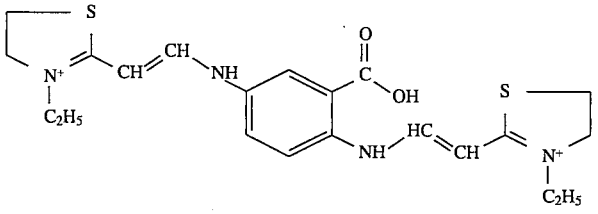

Sample 1 (Reference)

Hydrazide compound H-1 (0.8 millimoles per mole of silver) and contrast promoting agent CP-14 (5.0 millimoles per mole of silver) were added to the emulsion. A coating was then prepared by the application of the described mixture onto a subbed polyester base at silver coverage of 3.2 g/m$^2$ and a total gelatin coverage of 3.4 g/m$^2$, 2.9 g/m$^2$ being in the emulsion layer and the remaining in the top coat layer.

Sample 2 (Reference)

As Sample 1, but the hydrazide compound H-1 was replaced by hydrazine compound H-5 in the same amount.

Sample 3 (Invention)

As Sample 1, but dextran (0.70 g/m$^2$) having a molecular weight of 40,000 was added to the emulsion layer.

Sample 4 (Invention)

As Sample 2, but dextran (0.70 g/m$^2$) having a molecular weight of 40,000 was added to the emulsion.

Sample 5 (Comparison)

As Sample 4, but dextran was added in an amount of 0.35 g/m$^2$.

Sample 6 (Invention)

As Sample 4, but dextran was added in an amount of 0.50 g/m$^2$.

Sample 7 (Invention)

As Sample 4, but dextran was added in an amount of 1.40 g/m$^2$.

Sample 8 (Invention)

As Sample 3, but dextran was coated in the top-coat layer containing 0.5 g/m$^2$ of gelatin, rather than in the emulsion layer, in an amount of 0.50 g/m$^2$.

Sample 9 (Invention)

As Sample 3, but a further amount of 0,50 g/m$^2$ of dextran was coated in the top-coat layer.

The Samples were exposed in a sensitometer consisting of a 500 watt tungsten filament light source attenuated by a 0–4 continuous neutral density wedge in contact with the film sample. The film was then developed for 30 seconds at 35° C. in the 3M RDC V Rapid Access Chemistry (pH less than 11.0) and incubated in oven stressed conditions for 3 days at 60° C. and 50% relative humidity.

Table 1 shows the sensitometric values in terms of Toe contrast ΦA and in terms of shoulder contrast C1, respectively being the absolute value of the slope of the line joining the density points of 0.07 and 0.17 above Dmin and the absolute value of the slope of the line joining the density points of 0.10 and 2.50 above Dmin.

TABLE 1

| Sample | Hydr. | Dextran in emuls. g/m² | Dextran topcoat g/m² | Fresh ΦA | Fresh Cl | Fresh Dmin | Incubated ΦA | Incubated Cl | Incubated Dmin |
|---|---|---|---|---|---|---|---|---|---|
| 1 (ref.) | H-1 | 0 | 0 | 1.9 | 20 | 0.03 | 0.5 | 12 | 0.20 |
| 2 (ref.) | H-5 | 0 | 0 | 2.9 | 20 | 0.03 | 0.8 | 10 | 0.07 |
| 3 (inv.) | H-1 | 0.70 | 0 | 2.5 | 20 | 0.03 | 1.7 | 18 | 0.03 |
| 4 (inv.) | H-5 | 0.70 | 0 | 2.9 | 26 | 0.03 | 2.1 | 20 | 0.03 |
| 5 (comp.) | H-5 | 0.35 | 0 | 2.1 | 19 | 0.03 | 0.7 | 11 | 0.03 |
| 6 (inv.) | H-5 | 0.50 | 0 | 2.5 | 20 | 0.03 | 1.6 | 17 | 0.03 |
| 7 (inv.) | H-5 | 1.40 | 0 | 1.5 | 22 | 0.03 | 1.5 | 18 | 0.03 |
| 8 (inv.) | H-1 | 0 | 0.50 | 2.5 | 20 | 0.03 | 2.0 | 17 | 0.03 |
| 9 (inv.) | H-1 | 0.70 | 0.50 | 2.6 | 20 | 0.03 | 1.4 | 16 | 0.03 |

Table 1 shows that the addition of dextran causes an improvement of the sensitometric values after incubation. In fact, a lower decrease of the very high contrast values and a constancy of the Drain value are obtained (Samples 3,4,6,7,8,9), compared with the very bad results obtained by reference Samples 1 and 2. Sample 5 shows that the amount of dextran used is not sufficient to obtain good sensitometric results (ΦA value is too low after incubation test). Samples 8 and 9 show that dextran can be added also in the top-coat layer.

We claim:

1. A silver halide photographic element, free of photolytically generated latent images, comprising a support bearing at least one gelatin light-sensitive silver halide emulsion layer and at least one gelatin light-insensitive layer, the silver halide light-sensitive emulsion layer including negative acting surface latent image-type silver halide grain in association with a contrast promoting agent and a hydrazine compound, wherein a total amount of at least 0.40 grams per square meter of dextran is contained in at least a light-sensitive silver halide emulsion layer and/or in at least a light-insensitive layer.

2. Silver halide photographic element of claim 1 wherein dextran is added to at least one silver halide light-sensitive emulsion layer.

3. Silver halide photographic element of claim 1 wherein dextran is added to at least one silver halide light-insensitive emulsion layer.

4. Silver halide photographic element of claim 1 wherein dextran is added to a top-coat layer.

5. Silver halide photographic element of claim 1 wherein dextran is added in an amount of from about 0.50 to about 1.00 grams per square meter.

6. Silver halide photographic element of claim 1 wherein said contrast promoting agent has the following formula (I) or (II):

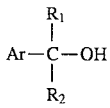

(I)

-continued

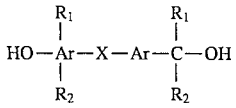

(II)

wherein Ar is an aromatic group; $R_1$ and $R_2$, the same or different, being hydrogen, an alkyl group or an aryl group; X is a divalent linking group containing at least three repeating ethyleneoxy units.

7. Silver halide photographic element of claim 1, wherein said hydrazine has the following formula (III):

$$R_3—NH—NH—G—R_4 \quad \text{(III)}$$

wherein $R_3$ represents an aliphatic group or an aromatic group, $R_4$ represents a hydrogen atom, an alkyl group, an aryl group, an alkoxy group, an aryloxy group, and G represents a carbonyl group, a sulfonyl group, a sulfoxy group, a phosphoryl group, or an amino group.

8. Silver halide photographic element of claim 1 wherein the amount of said contrast promoting agents is from about $10^{-4}$ to $10^{-1}$ moles per mole of silver.

9. Silver halide photographic element of claim 1 wherein the amount of said hydrazine compounds is from about $10^{-4}$ to $5\times10^{-2}$ moles per mole of silver.

10. Process for improving the ageing properties of a silver halide photographic element, free of photolytically generated latent images, comprising a support bearing at least one light-sensitive silver halide emulsion layer and at least one light-insensitive layer, the silver halide light-sensitive emulsion layer including negative acting surface latent image-type silver halide grain in association with a contrast promoting agent and a hydrazine compound, by adding a total amount of at least 0.40 grams per square meter of dextran to at least said light-sensitive silver halide emulsion layer and/or to at least said light-insensitive layer.

* * * * *